US005624299A

United States Patent [19]

Shendon

[11] Patent Number: 5,624,299

[45] Date of Patent: Apr. 29, 1997

[54] CHEMICAL MECHANICAL POLISHING APPARATUS WITH IMPROVED CARRIER AND METHOD OF USE

[75] Inventor: Norman Shendon, San Carlos, Calif.

[73] Assignee: Applied Materials, Inc., Santa Clara, Calif.

[21] Appl. No.: 431,951

[22] Filed: May 1, 1995

Related U.S. Application Data

[63] Continuation-in-part of Ser. No. 205,276, Mar. 2, 1994, which is a continuation-in-part of Ser. No. 173,846, Dec. 27, 1993.

[51] Int. Cl.[6] ..... B24B 1/00

[52] U.S. Cl. ..... 451/28; 451/388; 451/397; 451/285; 451/286; 451/287; 451/288; 451/289

[58] Field of Search ..... 451/285, 286, 451/287, 288, 289, 388, 397, 28

[56] References Cited

U.S. PATENT DOCUMENTS

| | | | |
|---|---|---|---|
| 4,669,226 | 6/1987 | Mandler | 451/364 |
| 4,918,869 | 4/1990 | Kitta | 51/131.1 |
| 5,081,795 | 1/1992 | Tanaka et al. | 51/131.1 |
| 5,193,316 | 3/1993 | Olmstead | 51/281 SF |
| 5,205,082 | 4/1993 | Shendon et al. | 451/41 |
| 5,230,184 | 7/1993 | Bukhman | 51/283 R |
| 5,255,474 | 10/1993 | Gawa et al. | 51/131.1 |
| 5,423,716 | 6/1995 | Strasbaugh | 451/287 |
| 5,441,444 | 8/1995 | Nakajima | 451/288 |
| 5,476,414 | 12/1995 | Hirose et al. | 451/288 |

FOREIGN PATENT DOCUMENTS

| | | | |
|---|---|---|---|
| 63-114870 | 5/1988 | Japan | 451/289 |

*Primary Examiner*—Robert A. Rose
*Assistant Examiner*—George Nguyen
*Attorney, Agent, or Firm*—Fish & Richardson, P.C.

[57] ABSTRACT

A carrier apparatus for positioning and biasing a substrate against a polishing pad. The carrier apparatus includes a resilient membrane which loads the substrate against the pad. The membrane is configured to create one or more vacuum regions which chuck the substrate to the membrane so that the carrier may move the substrate on and off the polishing pad. In addition, the membrane may be pressurized to dechuck the substrate and allow the substrate to be front loaded or to float on the polishing pad. A retaining ring is directly adhered to the membrane to define a substrate receiving portion of the membrane. The retaining ring limits twisting of the membrane with respect to the substrate. In addition, the membrane is protected from the polishing pad by a right angled and annular shield. The membrane has a circumferential dimple expansion member prevent the center of the membrane from doming during the polishing process.

26 Claims, 6 Drawing Sheets

164
56
160
59
52
36
61
88
54
78
76
79
73
73
80
24
162
22
16
214
26
10

CHEMICAL MECHANICAL POLISHING APPARATUS WITH IMPROVED CARRIER AND METHOD OF USE

RELATED APPLICATIONS

This application is a continuation-in-part to U.S. patent application Ser. No. 08/205,276 filed on Mar. 2, 1994, by Norman Shendon, entitled Chemical Mechanical Polishing Apparatus with Improved Polishing Control, which is a continuation-in-part to U.S. patent application Ser. No. 08/173,846, filed on Dec. 27, 1993, by Norman Shendon, entitled Chemical Mechanical Polishing Apparatus.

BACKGROUND OF THE INVENTION

1. Field of the Invention

The present invention relates generally to chemical mechanical polishing of substrates, more particularly to apparatus for, and methods of, chemically mechanically polishing semiconductor substrates and, even more specifically to a substrate carrier and the method of using the carrier in a chemical mechanical polishing apparatus.

2. Background of the Art

In certain technologies, such as integrated circuit fabrication, optical device manufacture and the like, it is often crucial to the fabrication processes involved that the workpiece from which the integrated circuit, optical, or other device is to be formed have a substantially planar front side and, for certain applications, have both a planar front side and back side.

One process for providing such a planar surface is to scour the surface of the substrate with a conformable polishing pad, commonly referred to as "mechanical polishing." When a chemical slurry is used in conjunction with the pad, the combination of slurry and pad generally provides a higher material removal rate than is possible with mere mechanical polishing. This combined chemical and mechanical polishing, commonly referred to as "CMP," is considered an improvement over mere mechanical polishing processes for planarizing or polishing substrates. The CMP technique is common for manufacture of semiconductor wafers used for the fabrication of integrated circuit die.

One recurring problem with CMP processing is the tendency of the process to differentially polish the surface of the substrate and thereby create localized over-polished and under-polished areas across the substrate surface. Where the substrate is to be further processed, such as by photolithographic etching to create integrated circuit structures, thickness variation in the planarized layer makes it extremely difficult to meet the fine resolution tolerances required to provide a high yield of functional die on a wafer.

In typical CMP apparatus, the substrate is received in a substrate carrier mechanism which positions the surface of the substrate to be polished on the pad, and which also provides a bias force between the surface of the substrate and the polishing pad. The carrier mechanism typically includes a recess within which the substrate must be retained for polishing, and within which the substrate should be retained when the carrier is lifted from the polishing pad where proper removal of the substrate from the carrier can be affected by the CMP machine operator.

A variety of techniques have been used to hold the substrate in the carrier. For example, a soft, resilient pad can be placed between a planar substrate mounting plate on the base of the carrier and the substrate, with the substrate held against the resilient pad by surface tension created by compressing the resilient pad with the substrate. In other prior art techniques, a polymer sheet or a wax mound has been used to hold the wafer to a planar substrate mounting plate. These solutions have been found to be less than desirable in resolving substrate handling difficulties in that the combination of the mounting plate and the conformable material may not be as flat as the desired flatness of the substrate and thus the carrier may differentially load the backside of the substrate. Such differential loading would cause localized high polishing pressure regions between the substrate and the pad, which will cause the formation of localized overpolished regions on the polished substrate.

An additional method of holding the substrate to the carrier is shown in U.S. Pat. No. 5,095,661, Gill wherein a vacuum is applied to the backside of the resilient pad against which the substrate is positioned, through one or more ports connected to a vacuum source such as a pump, to provide a releasable chucking means. Typically, the resilient pad is substantially porous, or through holes are also provided in the resilient pad between the carrier plate and the substrate, to create sufficient communication between the vacuum and the substrate to cause suction against the substrate back side to adhere it to the carrier as the carrier is lifted away from the pad. However, this configuration has been found to suck slurry up from the pad and into the vacuum ports and thereby contaminate the carrier mechanism.

Therefore, there is a need for a carrier head for CMP apparatus with improved substrate loading, retaining and unloading capability.

SUMMARY OF THE INVENTION

In its basic aspects, the present invention provides an apparatus for polishing substrates on a polishing pad. A carrier head is used to locate a first surface of at least one substrate to be polished on the polishing pad. The carrier has a flexible member adapted to adjoin the substrate at a second surface thereof, a support member having at least one aperture therethrough, and a mechanism for selectively applying a positive pressure or a vacuum pressure at the aperture(s). When the vacuum pressure is applied, the region of the flexible member adjacent the aperture(s) is pulled into the aperture(s) to create a suction force on the second surface of the substrate to adhere the substrate to the flexible member. To release the substrate from the flexible member, the vacuum pressure is released or a positive pressure may be applied through the apertures to deform the flexible member away from the apertures and thereby ensure that the substrate is released from the carrier head.

A positive pressure is maintained in the aperture(s) during polishing, such that the flexible member provides the coupling between the substrate and the carrier head. This allows the substrate to "float" with respect to the fixed surfaces of the carrier head, which prevents any localized overloading of the substrate on the polishing surface. After polishing is completed, the vacuum is applied to the aperture(s) to again releasably secure the substrate to the carrier head. Once the carrier head is located for substrate access from an operator or robot, zero net or positive pressure is again applied to the aperture(s) to cause the substrate to become dislodged from the flexible member. A new substrate is then loaded into the carrier head, the vacuum pressure is applied, and the head returns to the polishing surface to polish the substrate.

It is an advantage of the present invention that it provides a device for polishing substrates on a polishing pad with improved uniformity and yield.

It is another advantage of the present invention that it firmly holds a substrate for lifting from a slurry wetted polishing pad without drawing slurry into the holding mechanism.

It is yet another advantage of the present invention that it reliably retains a substrate therein when it is lifted from a slurry wetted polishing pad for allowing the CMP machine operator to remove it from the carrier.

It is yet another advantage of the present invention that it functions to both provide a substantially uniform load on a substrate held therein for polishing and reliably hold the substrate during separation from a polishing mechanism.

Other objects, features and advantages of the present invention will become apparent upon consideration of the following detailed description and the accompanying drawings, in which like reference designations represent like features throughout the FIGURES.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventor(s) for practicing the invention. Alternative embodiments are also briefly described as applicable.

CMP APPARATUS: OVERVIEW

Figure 1:
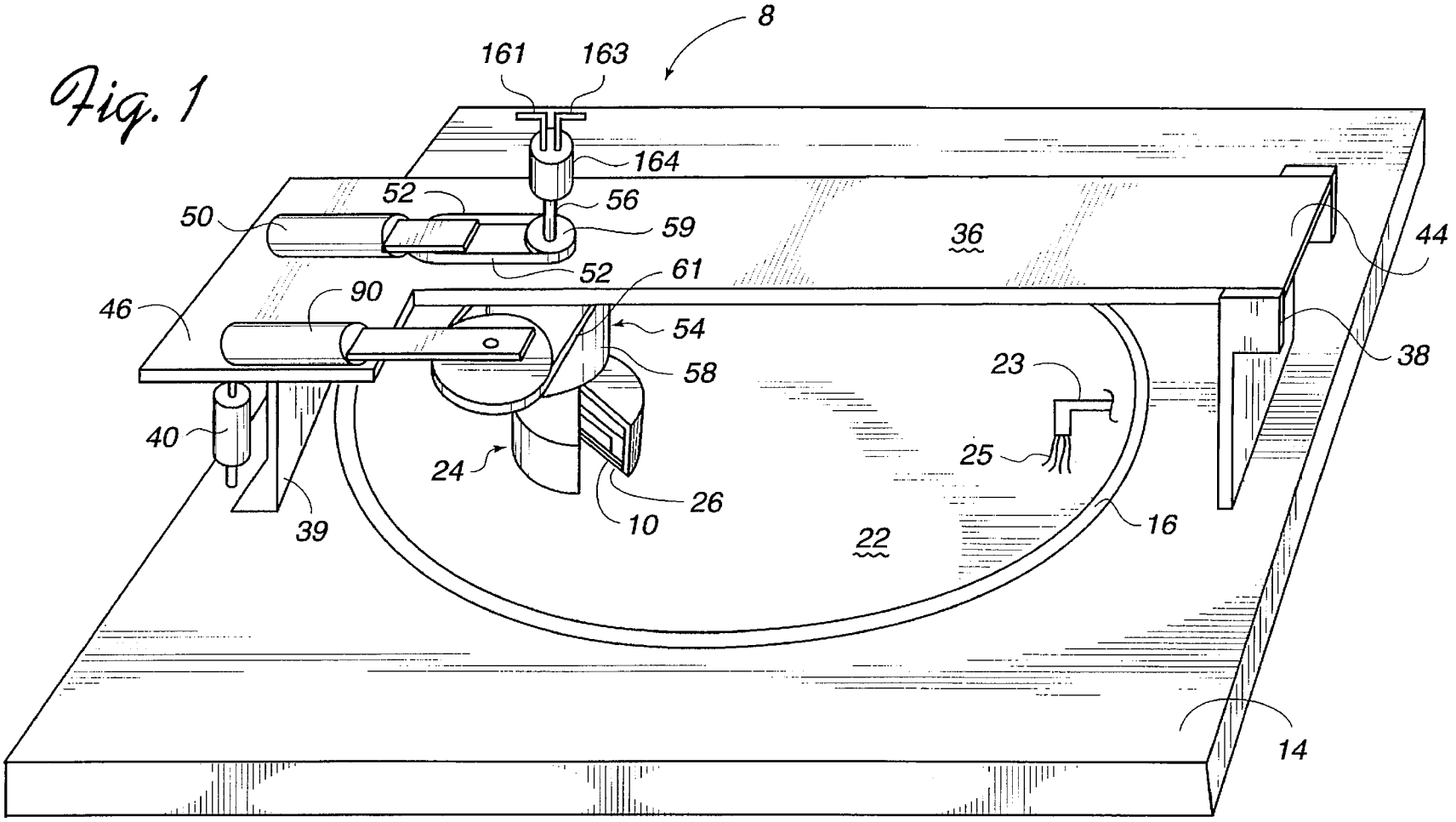
FIG. 1 is a perspective view, partially in section, of a CMP apparatus in which the present invention is employed.

Depicted in FIG. 1 is a polishing apparatus 8 useful for polishing substrates such as silicon wafers used in the fabrication of integrated circuit die.

The polishing apparatus 8 generally includes a base 14 which supports a platen 16 having a polishing pad 22 thereon. If motion, such as rotation, of the polishing pad 22 is desired, a drive mechanism, such as a motor and gear assembly (not shown), is disposed on the underside of the base 14 and is connected to the underside of the platen 16 to rotate the platen 16.

A slurry 25 is supplied to the polishing pad 22 and to the interface of the substrate and the pad 22 to enhance the polishing of the exposed surface of a substrate with the wetted polishing pad 22. The slurry 25 may be supplied to the polishing pad 22 through a slurry port 23 which drips or otherwise meters the slurry 25 onto the polishing pad (or, alternatively, slurry 25 may be supplied through a plurality beneath slurry passages (not shown) in the platen 16 of the polishing pad 22 so that it flows upwardly through the polishing pad 22 to the substrate-pad interface). Such pad and slurry combinations are known to those skilled in the art.

SUBSTRATE CARRIER AND DRIVE CONFIGURATION

The apparatus 8 includes a substrate carrier and drive configuration that provides three functions: (1) it secures the substrate during polishing; (2) it loads the substrate against the polishing pad; and (3) it controls the movement of the substrate relative to a stationary reference point. The carrier and drive configuration includes a carrier 24 within which the substrate is secured for polishing. A transfer case 54 extends between the carrier 24 and a movable cross-bar 36 to provide the loading and motion of the carrier 24 with the mounted substrate thereon, relative to the polishing pad 22.

To properly position the carrier 24 with respect to the polishing pad 22, the transfer case 54 is connected to the crossbar 36 which extends over the polishing pad 22. The crossbar 36 is positioned above the polishing pad 22 by a pair of opposed uprights 38, 39 and a biasing piston 40. The crossbar 36 is preferably connected to the upright 38 at a first end 44 with a hinge mechanism and is connected to the biasing piston 40 at a second end 46. The second upright 39 is located adjacently to piston 40 to provide a vertical stop to limit the downward motion of a second end 46 of the crossbar 36.

To remove and replace a substrate 10 on the carrier 24, the crossbar 36 is disconnected from the biasing piston 40 and the second end 46 of the crossbar 36 is pulled upwardly to lift the carrier 24 off the polishing pad 22. The substrate 10 can then be removed and replaced and the carrier 24 lowered to place the face 26 of the next substrate 10 to be polished against the polishing pad 22. Other configurations of the support mechanism for the carrier are possible, but do not affect the scope of the invention.

Figure 2:
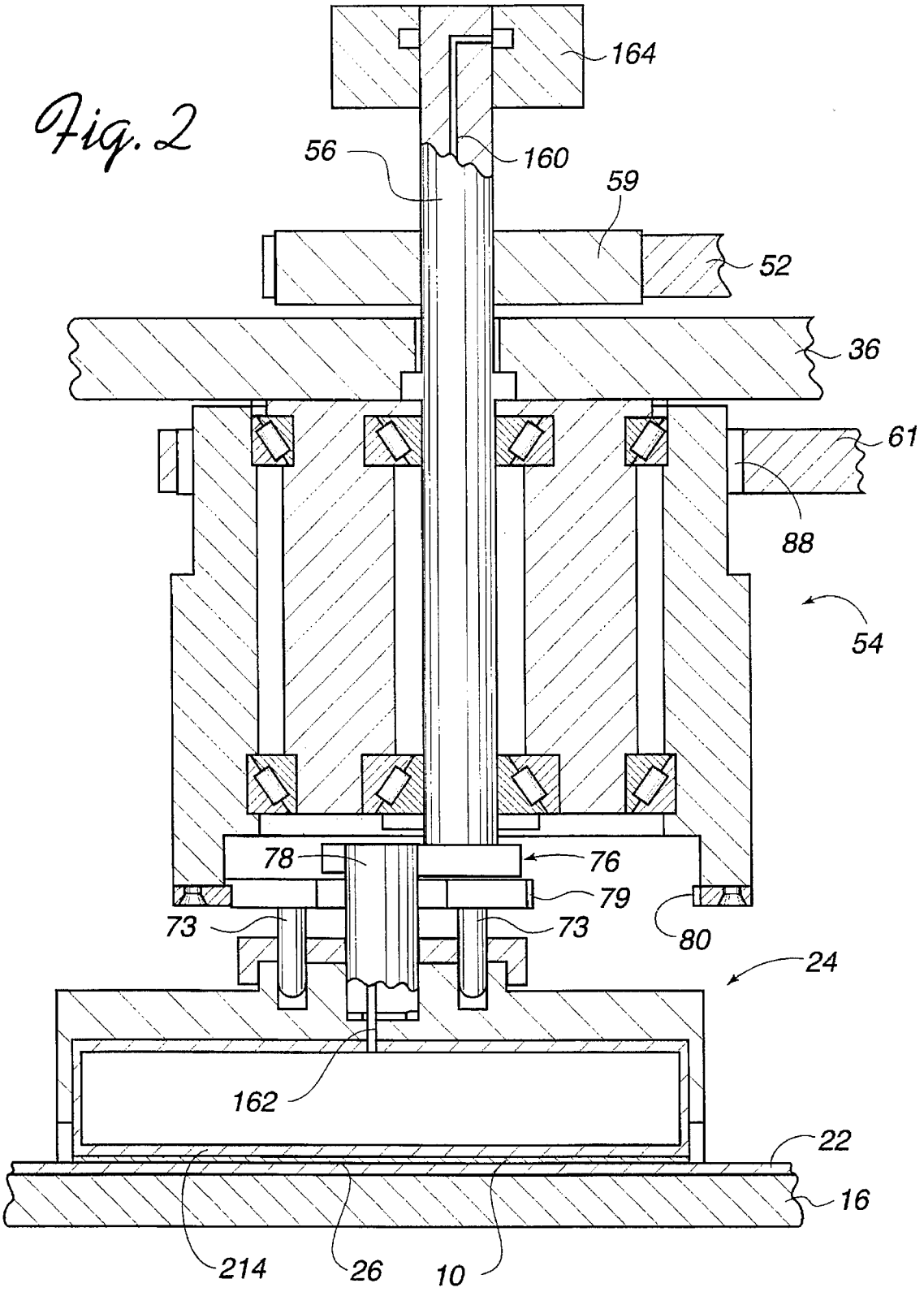
FIG. 2 is a sectional side view of a substrate carrier mechanism and carrier drive mechanism for the polishing apparatus as shown in FIG. 1.

Referring now to FIGS. 1 and 2, there is shown a configuration of the transfer case 54 configured to provide orbital and rotation movement of the carrier 24. The transfer case 54 links the carrier 24 to the crossbar 36. The transfer case 54 includes a drive shaft 56 that extends through the crossbar 36 and is coupled, via a rotatable sheave 59 and first drive belt 52, to a motor assembly 50 to provide rotational motion to the drive shaft 56. The lower end of the drive shaft 56 is received in an offset coupling 76 from which a second shaft 78 extends into the carrier 24. The drive shaft 56 and second shaft 78 are substantially parallel, such that when the shaft 56 rotates, it sweeps the second shaft 78 and the carrier 24 attached thereto through an orbital path. To impose rotational motion on the carrier 24 as it sweeps through the orbital path, a sun gear 79 is rotatably received over the second shaft 78 and a ring gear 80 is fixed to the lower end of the transfer case 54. A pair of pins 73 extend from the sun gear 79 into the head 24 to fix the rotational position of the head 24 to that of the sun gear 79. Thus, when the second shaft 78 sweeps the sun gear 79 in the orbital path, the sun gear 79 meshes with the ring gear 80 and causes the sun gear 79, and the head 24 pinned thereto, to rotate with respect the ring gear 80. Additionally, the ring gear 80 may be rotated independently of the shaft 56 by virtue of motion of a drive belt 61 (driven by motor 90 as shown in FIG. 1) connected over a belt receiving portion 88 of the transfer case 54. By selectively varying the direction and speed of the ring gear 80 rotation by changing the speed and direction of transfer case 54 rotation, the net movement between the substrate and the polishing pad 22 may be controlled.

THE IMPROVED POLISHING HEAD CONFIGURATION

Figure 3:
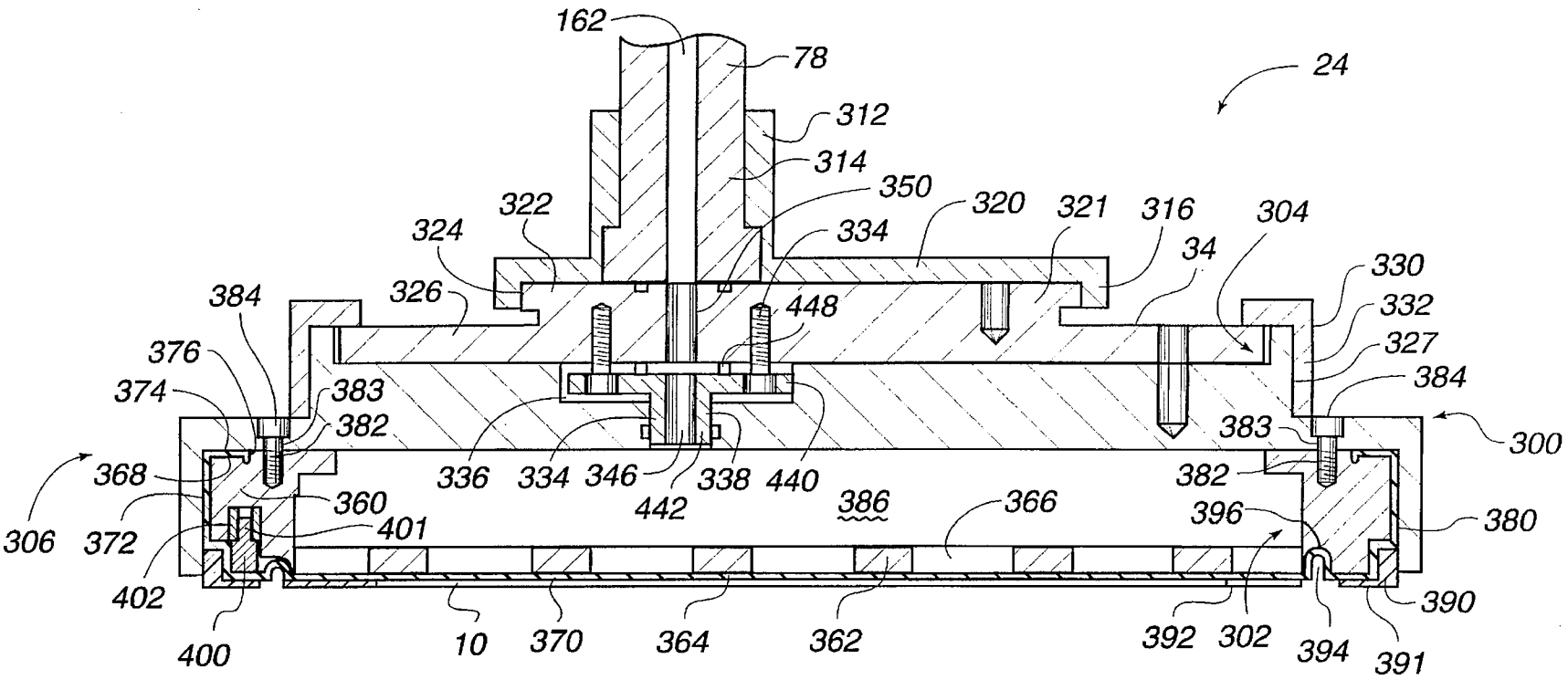
FIG. 3 is a sectional side view of the improved carrier of the present invention adapted for use in a polishing apparatus as shown in FIGS. 1 and 2.

Referring now to FIG. 3, there is shown, in section, the preferred configuration of the improved polishing head 24'.

In this embodiment, the head 24' includes a generally cylindrical body 300, having a large diameter recess 302 within which a substrate retaining and biasing assembly 306 is located, and a smaller diameter recess 304 through which the body 300 is coupled to the second shaft 78. To polish substrates 10 with the head 24', the substrate 10 is first loaded upwardly against the substrate retaining and biasing assembly 306, and the head 24' is lowered together with the substrate 10 against the polishing surface to position the exposed surface of the substrate 10 against the polishing surface 22 for polishing. Motion, preferably having both rotational and orbital components, is transmitted to the head 24' through the shaft 78, to provide motion between the polishing surface 22 and the substrate 10. Additionally, the polishing surface is preferably configured to move in a rotational direction, to also provide relative motion between the substrate 10 and the polishing surface.

During polishing, two factors which directly effect the rate of polishing of the substrate 10 by the surface of the polishing surface are the load of the substrate 10 against the pad and the net movement between the pad and the substrate 10 at each location on the substrate 10. The greater the force or the net motion, the greater the polishing rate of the substrate surface. Because the polishing surface rotates, the net motion of the polishing surface past a position on a stationary substrate will increase as the distance between that position and the rotational center of the polishing surface increases. However, if the substrate is simultaneously rotated, and the axis of the substrate rotation is also orbited about a specific location, the operator can cause the net motion between any point on the substrate and the pad to be equal throughout polishing. Therefore, the afore-described rotating transfer case 54, gears 79, 80 and shaft 56, 78 provide the requisite balancing of motion of the substrate 10 and the pad 22 to provide equal net movement between each location on the substrate and the pad, and thus equal polishing, on all surfaces of the substrate. However, notwithstanding the equalizing effect of simultaneous pad 22 rotation with substrate rotation and orbiting, the polishing uniformity will still suffer if the substrate is unevenly loaded against the polishing surface. In particular, if materials accumulate between the substrate 10 and a rigid substrate mounting surface, they will cause localized outward bowing of the substrate 22, and the surface of the substrate in the immediate vicinity of the particle will be over-polished.

The use of an inflatable bladder as a flexible substrate loading means to provide both the substrate mounting surface and the mechanism for loading the substrate 10 against the pad 22 substantially eliminates the problem of localized over-polishing of the substrate 10 resulting from particle contamination between the substrate 10 and a rigid mounting surface, because the bladder will deform away from the substrate where a particle is present to prevent outward bowing of the substrate 10 at the trapped particle site. However, a bladder, standing alone, provides problems for substrate loading and unloading. In particular, the conformal surface provided by the bladder to enable uniform loading of the substrate against the polishing surface does not have good substrate retention properties. Additionally the bladder, when pressurized, tends to form a sphere. The carrier confines the outer perimeter of the bladder in a generally cylindrical profile, but when lifted from the pad, the bladder will tend to extend convexly or outwardly at its center. Therefore, whenever the head 24' is lifted from the polishing surface, the substrate can easily become dislodged therefrom. Therefore, in the preferred embodiment of the invention, as shown in FIG. 3, the substrate retaining and biasing assembly 306 of the head 24' includes a bladder arrangement which uniquely provides a conformable surface to front reference the polishing of the substrate on the polishing surface, and a plurality of individual, selectively operable, vacuum grips to grip the substrate to the head during loading and unloading operation as will be further described herein.

Referring still to FIG. 3, the connection of the shaft 78 to provide controlled positioning and loading of the carrier 24' with respect to the pad 22 is shown. To enable the transfer of rotational and orbital motion of the drive assembly and to secure the head 24' to the second shaft 78, the second shaft 78 terminates within a cup-shaped adaptor 320, which has a central bore 312 for receiving the shaft end 314, and a downwardly extending outer threaded lip 316. This adaptor is received on an adaptor plate 321 which in turn is received in the small diameter recess 304 of the head 24', and which includes an upwardly extending central region 322, having an outer threaded cylindrical face 324 configured to be joined to the threaded lip 316 of the adaptor 320, and an outwardly extending flange portion 326. The body 300, adjacent the small recess 304, includes an outer threaded body adaptor portion 327, which is preferably configured as a right cylindrical threaded surface. To interconnect the head 24' and the shaft 78, the adaptor plate 321 is connected to the shaft 78 by threading the lip 316 of the adaptor 320 over the threaded face 324 of the adaptor plate. The adaptor plate 321 is also connected to the body 300 by extending a cup shaped body adaptor 330 over the top of the flange portion 326 of the adaptor plate 320 and threading the outer, downwardly extending, portion 332 of the cup shaped body adaptor 330 over the threaded body adaptor portion 327. Preferably, each of the cup-shaped members 320, 330 are manufactured from a material having high impact resistance and strength with low wear, but which, when exposed to metallic components of the head 24', will wear rather than cause wear on the metallic components. A preferred material for this use is Delrin®. The cup shaped members 320, 330 enable relative rotational motion between the shaft 78 and the adaptor plate 321 if required, and they also enable a small amount of vertical, i.e., perpendicular to the polishing surface, movement of these components relative to one another.

The adaptor plate 321, in combination with the body 300, also provides for sealed communication of a variable pressure means to the head 24'. As shown in FIG. 3, the body 300 includes a bore 334 therethrough, and a counterbored region 336 in alignment therewith. A pressure ring 338, having a plate like portion 440 and a stem portion 442 extending therefrom, is attached to the underside of the adaptor plate 321 with fasteners such as bolts 344. The pressure ring 338 includes a through bore 346 which extends through the axis of the plate like portion 440 and the stem 442. A seal ring 448, such as an O-ring, is located about the perimeter of the bore 334, and is compressed between the adaptor plate 321 and the pressure ring 338 to seal the bore 346. A pressure bore 350 extends through the adaptor plate 321 and is aligned with the through bore 346 and with a passage 162 in the second shaft 78. The through bore 346 terminates within the substrate receiving and biasing portion 306. Thus, fluid may be communicated between the substrate receiving and biasing portion 306 and the variable pressure source to change the pressure therein.

Figure 4:
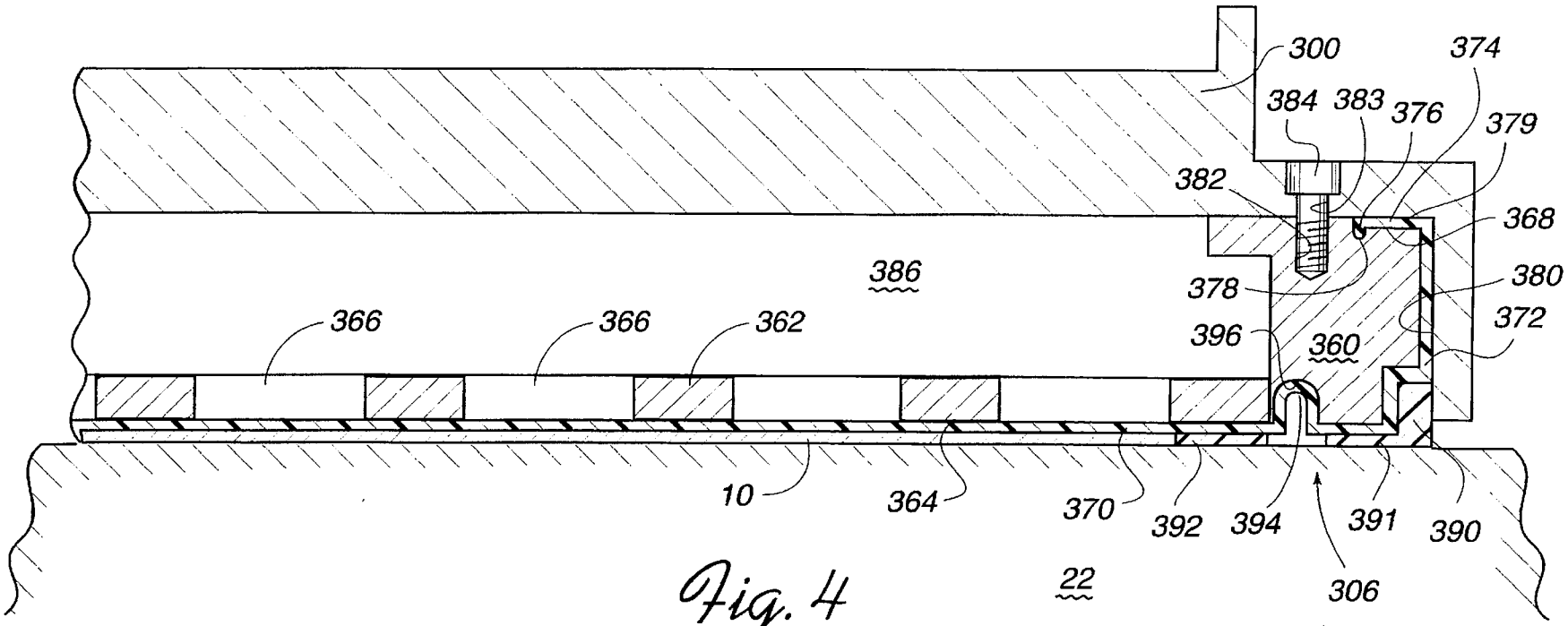
FIG. 4 is a partial sectional view of the body portion of the carrier of FIG. 3.

Referring now to FIGS. 3 and 4, the structure of the substrate receiving and biasing portion 306 to provide from referenced polishing and easy loading and unloading of the substrates from the head 24' is shown. Preferably, the substrate receiving and biasing portion 306 is a one-piece, removable member, which may be periodically replaced as a scheduled maintenance item. Essentially, the substrate receiving and biasing portion 306 includes a bladder support ring 360 which circumscribes a perforated plate 362 and over which a conformable bladder 364, preferably manufactured of synthetic or natural rubber, is stretched, such that the bladder 364 is located directly adjacent to perforations, or apertures 366, in the perforated plate 362. The support ring 360 is configured to be slightly smaller in outer diameter than an inner surface 380 of the large recess 302, and the bladder 364 preferably extends about this outer diameter of the support ring 360 and is secured to the upper annular face 368 of the support ring 360. Preferably, the bladder 364 is preformed to have a generally circular portion 370 terminating in an upwardly extending outer circumferential surface 372 which, in turn, terminates in an inwardly extending web 374. A downwardly extending lip 376 is provided on the web 374, and the support ring 360 preferably includes an circular recess 378 which receives the lip 376 to provide the proper alignment of the bladder with the support ring 360. To load the bladder 364 over the ring, the outer circumferential surface 372 of the bladder is deformed outwardly, and the support ring 360 is inserted into the bladder such that the web 374 of the bladder overlays the upper face of the support ring 360. The bladder web 374 is then released and the lip 376 is pressed into the recess 378 in the support ring 370.

To secure the substrate receiving and biasing portion 306 in the large recess, the upper face 368 of the support ring 360 preferably includes a plurality of threaded apertures 382 therein, which correspond to a plurality of mating, counterbored clearance apertures 383 in the body 300. A plurality of bolts 383 are extended through the clearance apertures 382 and threaded into the threaded apertures 382 to pull the support ring 360 tightly against the inner face of the large recess 302. Because the bladder web 374 extends over the upper surface 368 of the ring 360, the securing of the support ring 360 to the body 300 compresses the bladder between these surfaces to create a sealed bladder chamber 386.

Figure 5:
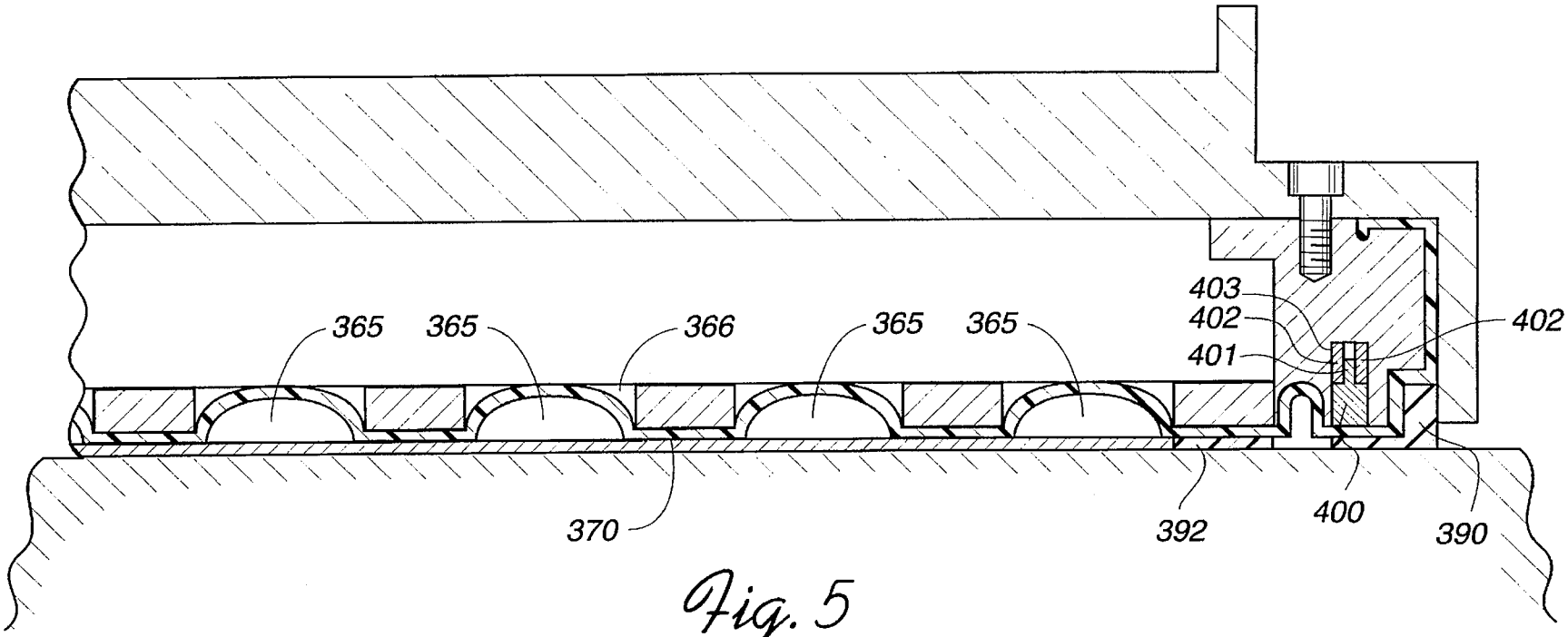
FIG. 5 is a partial sectional view of the body portion of the carrier of FIG. 3, showing the substrate being gripped to the body portion.

To operate the head 24' for substrate 10 loading and unloading, a vacuum is drawn through the passage 162 (shown in FIG. 3) to maintain a vacuum pressure in the chamber 386. The low pressure region within the bladder chamber 386 permits the ambient pressure on the exterior of the bladder chamber 386 to force the portions of the circular portion 370 of the bladder 364 overlying each aperture 366 to be pulled into the aperture 366 as shown in FIG. 5. When a substrate 10 is engaged against the circular portion 370 before the vacuum is enabled, the subsequent movement of the bladder 364 into the apertures 366 creates a localized vacuum gripping between the substrate 10 and the bladder 364 at each aperture 366 because vacuum gripping regions 365 are created between the substrate 10 and the bladder 364 at each aperture 366. The vacuum gripping is sufficient to maintain the substrate 10 against the bladder 364 as the head 24' is manipulated to lift the substrate 10 off the polishing pad 22. To remove the substrate from the head 24', the chamber 386 is returned to ambient pressure conditions which allows the bladder 364 to move from the apertures 366 in the perforated plate and thereby eliminate the vacuum gripping regions 365 between the substrate 10 and the bladder 364 as shown in FIGS. 3 and 4, which allows the substrate to be removed from the carrier head 24'. Alternatively, the chamber 386 may be pressurized, which will expand the bladder 364 away from the perforated plate 362 and tend to dislodge the substrate 10 from the head 24'.

During loading and unloading operations of the substrate 10 from the head 24', the chamber 386 is cycled through the vacuum and high pressure regimes. However, during polishing, the chamber 386 is maintained in a pressurized state, such that the circular face 370 of the bladder moves away from the perforated plate 362, and the substrate 10 is able to float, or become "front referenced," as it is polished.

The movement of the bladder 364 which occur between the vacuum and pressurized conditions will cause the circular face 370 and outer cylindrical surface of the bladder 364 to move with respect to the body. Additionally, localized variations of the polishing pad 22 surface will cause small movement of these portions of the bladder 364 relative to the body 300. This movement could cause the outer surface of the bladder 364 to rub against the inner surfaces 380 of the large recess 302, or to become pinched between the body 300 and the polishing surface, which would result in wear and premature failure of the bladder 364. Additionally, if the bladder 364 contacts the polishing surface, high wear, and premature failure, of the bladder 364 will result.

Referring again to FIGS. 3 and 4, to protect the bladder 364 from the polishing surface 22, and to reduce the wear of the outer cylindrical surface of the bladder, a right angled, annular shield 390 is provided about the intersection of the circular face 370 of the bladder with the circumferential face 372 of the bladder. The shield 390 provides two functions: it provides a protective lip 391 to protect the bladder at the edge of the circular face 370 from the polishing surface 22; and it provides a piloting and bearing surface between the inner surface 380 of the large recess 302 and the circumferential face 372 of the bladder 364 and thereby prevents the bladder 364 from wearing by frictional engagement with the inner surface 380 of the large recess.

During polishing, when the chamber 386 is pressurized, the circular face 370 of the bladder which is enveloped within the circumference of the shield 390 may become domed, because the edge of the bladder 364 is relatively rigidly retained by the shield 390 but the center of the bladder within the shield 390 is free to move outwardly of the body 300. Additionally, because the bladder 364 is substantially flexible, localized variations in the pad density or thickness could allow substantial tilting of the substrate with respect to the circular face 370. If bladder doming or substantial substrate tilting occur, the substrate 10 could work itself free of the polishing head 24'. To address this problem, a retainer ring 392 is integrally located on or bonded to the circular face of the bladder, and this retainer ring 392 circumscribes the substrate receiving region of the bladder. Additionally, a circumferential dimple 394 is integrally provided in the bladder between the retainer ring 392 and the shield 390 to enable relative radial and vertical movement of the ring 392 with respect to the shield 390. This dimple will be more fully described below.

The retainer ring 392 provides dimensional stability, i.e., rigidity, to the bladder 364 immediately outwardly of the position of the substrate 10 held in the bladder 364. As a result of this rigidity, the retainer ring 392 will maintain the circular face 370 in a generally planar mode, so that the substrate and the circular face 370 and retainer ring 392 will move in unison as the substrate tilts with respect to the polishing surface of the pad 22.

Figure 6:
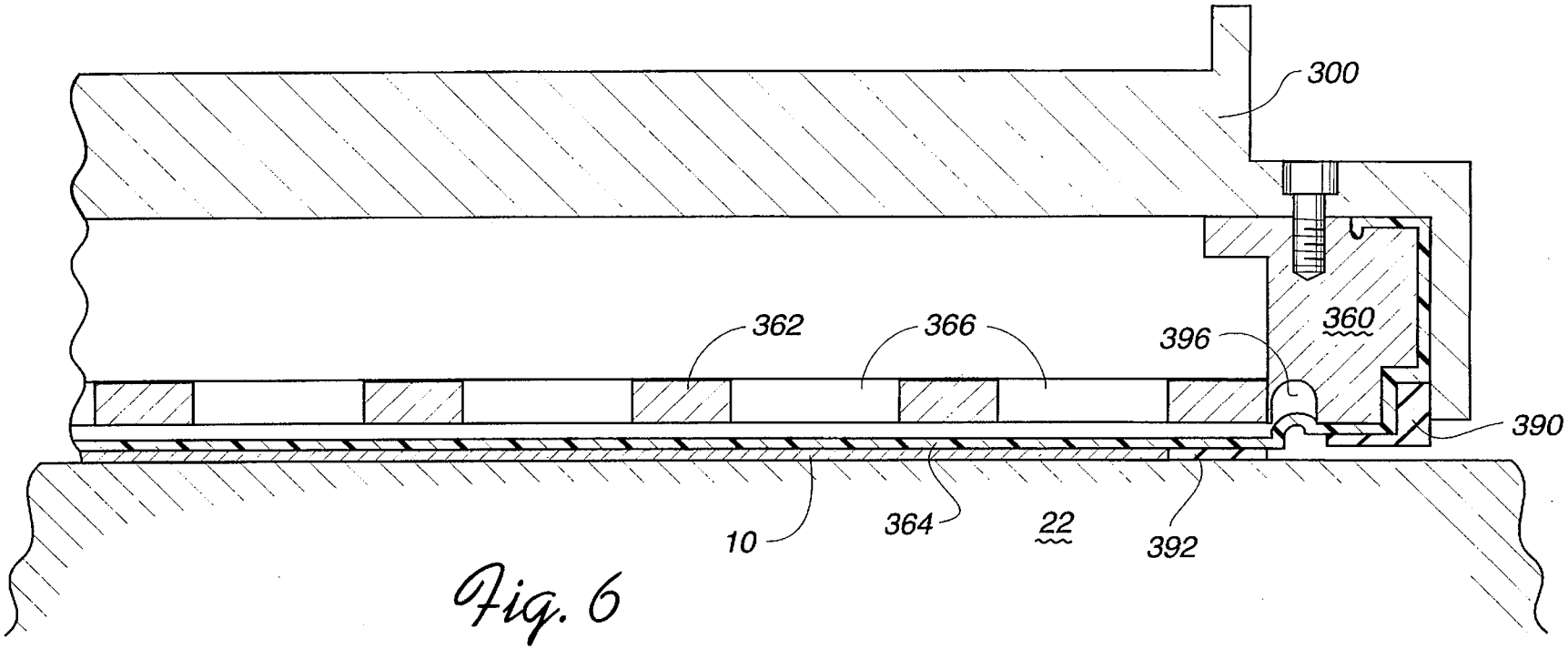
FIG. 6 is a partial sectional view of the body portion of the carrier of FIG. 3 showing the configuration thereof during substrate polishing operations.

To enable tilting of the retainer ring 392 and the substrate receiving portion with respect to the shield 392, as well as the extension of the retainer ring 392 and substrate receiving portion from the perforated plate 362 with minimal twisting of the retainer ring 392 or the bladder material 366 contacting the substrate 10, an expansion seam, flexible coupling or expansion member in the form of a dimple 394 is located between the retainer ring 392 and the shield 390. This dimple 394 allows the retainer ring 372 and the circular face 370 therebetween to move substantially inwardly and outwardly of the chamber 386 without significantly stressing the portion of the bladder located outwardly of the dimple 394, i.e., it provides a residual length or portion of bladder material as shown in FIG. 6. Further, the dimple 394 provides a flexible hinge to decouple the movement of the inner and outer portions of the bladder 364. Absent this dimple 394, when the substrate tends to tilt with respect to the relatively planar shield 390, the bladder 364 will stretch or twist to accommodate the tilting, which would deform the planarity of the lower surface of the retainer ring 392 and thereby create uneven loading of the retainer ring 392, and of the substrate 10 adjacent to the retainer ring 392, on the polishing pad 22 surface. However, with the dimple, the retainer ring 392 will remain co-planar with the substrate when the substrate tilts, to accommodate changes in polishing surface planarity and density, because the tendency of the bladder material to stretch will be compensated for by the tendency of the dimple 394 to become flat to provide non-stretched, i.e., non-stressed, residual bladder material to compensate for the tilting of the bladder. Likewise, the dimple 394 at locations diametrically opposed to the expanding portion will compress as the retainer ring 392 and the substrate 10 tilt. Thus, the dimple 394 enables the retainer ring 392 to define a circumferential region of the bladder 364 within which substantial planarity may be maintained, and variations in polishing surface thickness and density may be accommodated without risk that the substrate 10 may become dislodged from the polishing head 24'. Additionally, the retainer ring 392 and the substrate 10 will maintain substantial planarity relative to one another, which improves the retaining characteristic of the retainer ring 392.

Referring again to FIGS. 3 and 4, to secure the dimple 394 in the head 24', the support ring 360 includes a circumferential recess 396 therein, which conforms to the shape of the dimple 394. To ensure that the dimple 394, and the remainder of the bladder components are relatively rigidly constrained, and to maintain the planarity of the shield ring 390, a secondary retainer 400 shown in FIGS. 3 and 5 is located between the polishing surface engaging portion of the shield 390 and the support ring 360. The secondary annular retainer 400 includes a plurality of pins 401 extending therefrom, which are received in sleeves 402 located in apertures 403 within the support ring 360. Preferably, the secondary retainer 400, the retainer ring 392 and the shield ring 390 are adhered to the bladder 364, or are molded thereto, during bladder fabrication. The secondary retainer 400 prevent substantial twisting of the shield ring 390 resulting from differential rotational loading on the substrate 10, the retainer ring and the shield ring 392, 390.

What I claim is:

1. A carrier for removably positioning a substrate on a polishing surface, comprising:

a body portion having a recess and an opening to said recess;

a plate extending across said opening to define a chamber, said plate including an exposed face and a plurality of passages from said exposed face through said plate to said chamber;

a flexible member extending over said plate and, in conjunction with said chamber, forming a sealed cavity;

a port extending into said sealed cavity to selectively evacuate said sealed cavity to pull said flexible member into said passages, and to selectively pressurize said sealed cavity to urge said flexible member away from said plate; and a retainer ring connected to a movable portion of said flexible member.

2. The carrier of claim 1, further including a support ring extending about the perimeter of said plate and connected to said body portion.

3. The carrier of claim 2, wherein said sealed cavity includes an annular outer wall, and said support ring is received in said recess within the perimeter of said annular outer wall.

4. The carrier of claim 1, further including a retainer ring connected to said flexible member and defining a substrate receiving surface of said flexible member within its circumference.

5. The carrier of claim 4, further including a material expansion member extending about the perimeter of said retainer ring.

6. A method of polishing a substrate on a polishing surface, comprising the steps of:

providing a carrier selectively positionable over the polishing surface;

providing a recess, having an opening facing the polishing surface when the carrier is positioned over the polishing surface, in the carrier;

extending a plate having at least one aperture therein over the opening;

extending a flexible member over the plate and intermediate of the plate and the polishing surface so as to create a sealed cavity within the perimeter of the flexible member and the recess;

positioning a substrate against the flexible member;

providing a vacuum in the sealed cavity to create at least one vacuum region between the substrate and the flexible member;

providing a retainer ring on the exposed surface of the flexible member;

positioning the substrate within a region defined by the inner perimeter of the retainer ring; and providing an expansion seam radially outwardly of the retainer ring to enable relative motion of the retainer ring without distorting the flexible member within the inner perimeter of the retainer ring.

7. The method of claim 6, wherein said expansion seam is an integral portion of the flexible member.

8. The method of claim 7, wherein said expansion seam is a dimple which projects inwardly of said recess.

9. The method of claim 6, further including providing a positive pressure in said sealed cavity while moving said carrier relative to said polishing surface to thereby press the substrate against the polishing surface.

10. A carrier apparatus for removably positioning a substrate on a polishing surface, comprising;

a body portion having an outer annular wall, a recess and an opening to said recess;

a plate extending across said opening, said plate including an exposed face and at least one aperture from said exposed face through said plate;

a support ring positioned in said recess, said support ring extending about the perimeter of said plate and connected to said body portion;

a flexible member extending over said plate and between said support ring and said annular outer wall, said flexible member forming, in conjunction with said recess, a sealed cavity; and a port extending into said sealed cavity to selectively evacuate said sealed cavity.

11. The carrier of claim 3, wherein said flexible member extends between said support ring and said annular outer wall.

12. The carrier of claim 11, further including a shield received on said flexible member and extending over at least a portion of the interface between said outer annular wall and said flexible member.

13. The carrier of claim 12, wherein said shield further includes a lip portion extending partially between said flexible member and the polishing pad.

14. A carrier apparatus for removably positioning a substrate on a polishing surface, comprising;

a body portion having a recess and an opening to said recess;

a plate extending across said opening, said plate including an exposed face and at least one aperture in said exposed face of said plate;

a flexible member extending over said plate, said flexible member forming, in conjunction with said recess, a sealed cavity;

a port extending into said sealed cavity to selectively evacuate said sealed cavity;

a retaining ring connected to said flexible member and defining a substrate receiving surface of said flexible membrane within its circumference; and a material expansion member extending about the perimeter of said retainer ring.

15. The carrier of claim 14, wherein said expansion member is an integral portion of said flexible member.

16. The carrier of claim 15, wherein said expansion member is a circumferential dimple extending inwardly of said cavity.

17. The carrier of claim 14, wherein said retainer ring is moveable with respect to said plate.

18. A carrier for positioning a substrate against the surface of a polishing material, comprising:

a body portion;

a conformable material, having at least a first surface and a second surface, received on said body portion and deformable therefrom by the application of fluid pressure against said first surface thereof;

a retainer connected to said second surface and defining a substrate receiving surface within its perimeter; and a flexible coupling between said retainer and portions of said conformable material disposed radially outwardly of said retainer.

19. The carrier of claim 18, wherein said flexible coupling is an integral portion of said conformable material.

20. The carrier of claim 18, wherein said body portion further includes a recess, and said conformable material sealingly covers said recess to form a fluid cavity therein.

21. The carrier of claim 20, further including a plate, having at least one aperture therethrough, received within said recess.

22. The carrier of claim 20, further including a port extendable into said recess to change the pressure therein.

23. The carrier of claim 18, wherein the plane defined by said substrate receiving surface is variable with respect to the polishing surface during polishing of the substrate.

24. The carrier of claim 22, wherein a portion of said flexible member extends inwardly of said aperture if a vacuum pressure is maintained in said fluid cavity.

25. The carrier of claim 24, further including a substrate received against said conformable material; and a vacuum region formed between said conformable material and the substrate when the conformable material is pulled inwardly of said aperture.

26. A carrier apparatus for removably positioning a substrate on a polishing surface, comprising;

a plate having an exposed face and at least one aperture in said exposed face;

a flexible member extending over said plate, said flexible member forming, in conjunction with said aperture, a sealed cavity;

a port extending into said sealed cavity to selectively evacuate said sealed cavity to pull said flexible member into said aperture, and to selectively pressurize said sealed cavity to urge said flexible member away from said plate; and a retainer ring connected to a movable portion of said flexible member.

* * * * *